US007025300B2

(12) United States Patent
Glassey

(10) Patent No.: US 7,025,300 B2
(45) Date of Patent: Apr. 11, 2006

(54) OPTIMUS CSB (INSTALLATION) DISPENSING TOOL AND MULTI-BELT HOISTING CLAMP

(75) Inventor: Thomas E. Glassey, Plainville, CT (US)

(73) Assignee: Otis Elevator Company, Farmington, CT (US)

( * ) Notice: Subject to any disclaimer, the term of this patent is extended or adjusted under 35 U.S.C. 154(b) by 215 days.

(21) Appl. No.: 10/294,190

(22) Filed: Nov. 14, 2002

(65) Prior Publication Data

US 2003/0085080 A1 May 8, 2003

Related U.S. Application Data

(62) Division of application No. 09/616,571, filed on Jul. 14, 2000, now Pat. No. 6,533,077.

(51) Int. Cl.
*B65D 85/02* (2006.01)

(52) U.S. Cl. ..... 242/588.3; 242/588.4; 206/409; 206/395

(58) Field of Classification Search ..... 242/588.3, 242/588.4, 588.6, 129; 206/409, 395
See application file for complete search history.

(56) References Cited

U.S. PATENT DOCUMENTS

| | | | | |
|---|---|---|---|---|
| 653,211 | A * | 7/1900 | Calkins | 242/588.3 |
| 1,020,101 | A | 3/1912 | Kinsella | |
| 1,076,635 | A * | 10/1913 | Howard | 242/588.6 |
| 2,017,405 | A * | 10/1935 | Pantalone | 206/395 |
| 2,890,821 | A * | 6/1959 | Becker | 225/43 |
| 3,693,784 | A * | 9/1972 | Holmes | 206/409 |
| 3,744,698 | A * | 7/1973 | Nederveld | 206/395 |
| 3,880,287 | A * | 4/1975 | Loeffelman | 206/397 |
| 4,006,854 | A * | 2/1977 | Gibson et al. | 206/409 |
| 4,168,778 | A * | 9/1979 | Buxton | 206/409 |
| 4,586,671 | A * | 5/1986 | Piana et al. | 242/594.3 |
| 4,978,085 | A * | 12/1990 | Letourneau | 242/588.3 |
| 5,248,081 | A * | 9/1993 | Hook | 229/117.14 |
| 5,529,186 | A * | 6/1996 | Bass | 206/395 |
| 5,704,479 | A | 1/1998 | Barnett et al. | |
| 6,179,244 | B1 | 1/2001 | Rodriguez | |

FOREIGN PATENT DOCUMENTS

| | | |
|---|---|---|
| FR | 2 668 130 A1 | 4/1992 |
| FR | 2 760 440 A1 | 9/1998 |
| FR | 2 787 094 A1 | 6/2000 |
| JP | 60-228383 A | 11/1985 |
| JP | 10-338437 | 12/1998 |

OTHER PUBLICATIONS

French Search Report dated Mar. 31, 2003.

* cited by examiner

*Primary Examiner*—Kathy Matecki
*Assistant Examiner*—Sang Kim
(74) *Attorney, Agent, or Firm*—Carlson, Gaskey & Olds

(57) ABSTRACT

A method and apparatus for installing a plurality of coated steel belts as tension members for an elevator system. A dispenser is employed that retains a plurality of rolled steel belts aligned vertically in said dispenser. An axel passing through the side walls of the dispenser and the centers of the steel belts rolls contained therein rotatably supports the steel belt rolls. When employing the disclosed method, equal lengths of the belts are pulled from the dispenser and clamped between two metal plates. A guide is then connected to the clamped plates which is used to feed the secured coated steel belts down the elevator shaft, around the sheave mechanism and back up the elevator shelf. The center core of the dispenser allows for the even systematic dispensing of steel belts so that equal lengths of the steel belts are fed simultaneous throughout the elevator system.

9 Claims, 5 Drawing Sheets

OPTIMUS CSB (INSTALLATION) DISPENSING TOOL AND MULTI-BELT HOISTING CLAMP

This application is a divisional application of U.S. patent application Ser. No. 09/616,571, which was filed on Jul. 14, 2000, now U.S. Pat. No. 6,533,077.

FIELD OF THE INVENTION

This invention relates to a method of installing a plurality of coated steel belts as tension members for elevator systems.

BACKGROUND OF THE INVENTION

Conventional traction elevator systems include a passenger car, a counterweight, two or more wire cables interconnecting the passenger car and the counterweight, a traction sheave to move the cables and a machine to move the traction sheave. Although this design has proven reliable and cost effective for many years, the wire cables employed in such a system have limited service lives. This limitation is the result of several factors. For example, to enhance friction forces between the cable and the sheave, the wrap angle of the cable is either increased or another possibility is to undercut grooves in the sheave. Both techniques subject the cable to increased wear and/or increased rope pressure. Another limitation associated with traditional steel cables is the need to produce cables of a sufficient diameter to comply with elevator safety codes. The imposed cable diameters require larger sheave diameters, which in turn, require greater torque from the machine used to drive the system.

The greater applied torque combined with pressure imposed by the sheave, subjects conventional elevator cables to great stress, which in turn shortens the service life as a tension member. Engineers under the direction of Otis Elevator, designed an elevator tension member that effectively minimized the various stress forces on the member so as to produce a more durable tension member with a longer service life than conventional cables. To accomplish this goal, the tension member consists of a plurality of individual load carrying cords encased within a common layer of coating that separates the individual cords while at the same time defining an engagement surface for the traction sheave. The coating layer is formed from a polyurethane material extruded onto and through the plurality of cords. The resulting tension member is relatively flat. The flattening out of the tension member minimizes the thickness and maximizes the width of the tension member without sacrificing cross-sectional area or load carrying capacity. As a result, stronger more flexible "belt-like" elevator tension members are produced. Details relating to the manufacture of coated steel elevator tension belts are disclosed in commonly owned U.S. patent application Ser. No. 406,453, now U.S. Pat. No. 6,295,799, the contents of which are herein incorporated in their entirety by reference. This novel tension member shall hereinafter be referred to as a "coated steel belt." This design distributes the pressure more uniformly throughout the tension member, thus reducing the maximum pressure applied to the tension member as compared to a conventional cable having a similar load capacity. Furthermore, the effective member diameter of the sheave is minimized which in turn reduces the magnitude of the torque needed to drive the sheave which in turn increases the rotational speed. Coated steel belts permit the use of less costly, more compact high speed motors as the driving mechanism of the elevator system.

The traction sheave and one surface of the coated steel belt are complimentary contoured to provide traction and to guide the engagement between the coated steel belt and the sheave. Conventional elevator cables, having no such traction enhancing contouring, need only be individually fed down the elevator shaft for installation. It was discovered that attempts to install the novel coated steel belts using traditional elevator cable installation methods were time consuming and resulted in damage to the belts. Because of its contoured surface, diligent attention was required to ensure proper installation of the coated steel belts so that the contoured surface of the belts came in contact with the surface of the sheave. The coated steel belts have a tendency to twist when fed individually down the elevator shaft. This twisting can damage the belt. Therefore, there exists a need for a new and improved method of installing coated steel belts as tension members in elevator systems without causing twisting of the coated steel belts during installation.

SUMMARY OF THE INVENTION

In view of the forgoing disadvantages inherent in the conventional methods present in the prior art, the present invention provides an improved method of installing coated steel belt tension members in elevator systems.

It was a goal of the present inventor to provide a low cost easy-to-use storage and feeding device which can readily accommodate and dispense a plurality of belts in an exceptionally rapid manner. Due to the spatial limitations associated with elevator systems, the dispensers need to be easily lifted and transported to the elevator machine room or hoistway.

To accomplish this goal, the present inventor devised a portable coated steel belt dispensing device capable of portioning out a plurality of belts. A continuous coated steel belt is rolled from end to end and is retained in place in a box-like structure. A hollow core is passed through two opposing holes in the side walls of the dispenser through the center of the steel belt roll. The core is cradled by the side walls of the dispenser. The walls of the box-like structure can be made from corrugated plastic or cardboard. The core acts as an axle rotatably supporting the coated steel belt rolls. A plurality of steel belt rolls can be rotatably supported by a single core so long as the center of the rolls have similar dimensions.

The wall of the dispensing device located at the free end of the steel belt roll has an elliptical perforation that can be punched out by the technician during installation to retrieve the free ends of the rolls. When a dispensing force is exerted on the free end of the coated steel belt roll which is generally greater than the relative weight of the roll, the roll begins to systematically unravel, dispensing the belt out of the aforementioned perforated slit. The dispensing force is created by the technician pulling on the free end of the steel belt roll causing the roll to rotate on the core.

To position a plurality of steel belts in the dispenser, the technician deposits the desired number of steel belt rolls of equivalent lengths side-by-side vertically in the dispenser. The rolls should be positioned in the dispenser so that hollow centers of the rolls are aligned so that the core can be passed easily through each roll. The cylindrical perforations formed in the side walls of the dispenser are removed forming a hole in each side panel and the cylindrical axle is passed through one side panel hole, therethrough the centers of the steel belt rolls and then partially through the opposing hole in the opposite wall of the dispenser so that the ends of the axle are rotatably supported by the two side walls. If assembled correctly, the plurality of steel belt rolls should be rotatably supported by said axle.

To install a plurality steel belts in an elevator system in accordance with this invention, the technician first removes the elliptical perforation formed in the forward panel of the dispenser to retrieve the terminal ends of the individual belts. The technician unrolls equal amounts of the coated steel belts and aligns the edges. The terminal ends of the coated steel belts are then secured between two steel plates bolted together so as to apply a compression force on the ends of the steel belts sufficient to retain the belts, tightly. The clamped steel belts are then fed throughout the path of the elevator system and positioned in place.

The method described herein offers many advantages over the prior art method of installing elevator support means. First, it offers an efficient way to install coated steel belts. Second, a plurality of elevator steel belts can be installed at the same time, saving installation time, thus decreasing costs. Finally, the described method effectively eliminates twisting of the belts that can cause damage and properly aligns the coated steel belts with the sheaves.

DETAILED DESCRIPTION OF THE INVENTION

Figure 1:
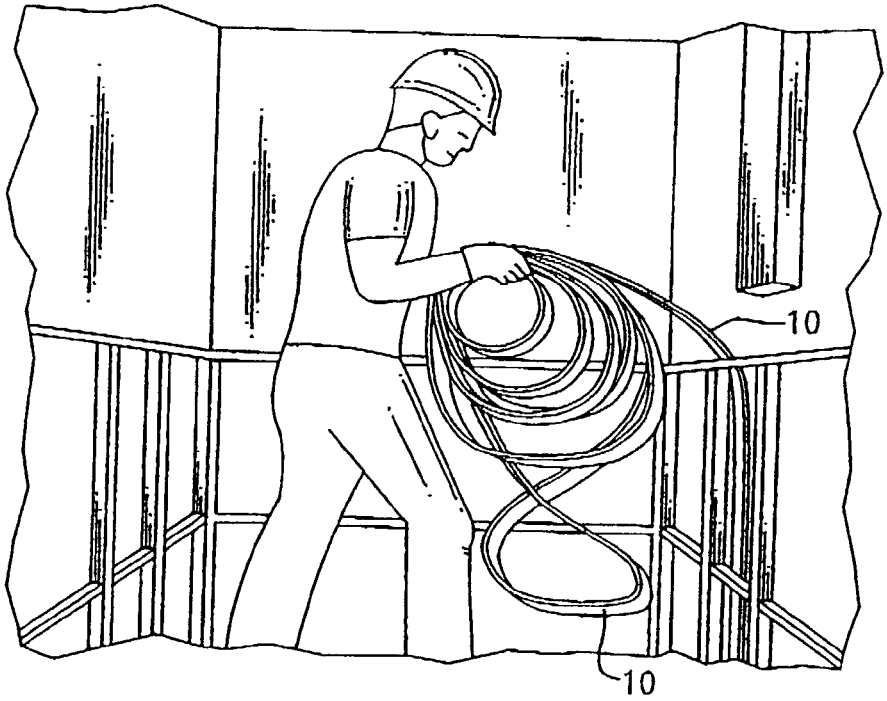
FIG. 1 Prior Art
FIG. 1 is a perspective view of the prior art method of installing coated steel belts as tension member in elevator systems.

Referring to FIG. 1, (Prior Art) as stated previously, Otis Elevator has introduced into the art of elevator systems coated steel belts 10 used as tension members. These new belts 10 are stronger and more flexible than the conventional wire cables providing many advantages. Originally, traditional methods of installing the wire cables were also utilized to install said steel belts 10. In particular, the steel belts were fed down the elevator shaft individually, around one sheave, up the shaft and around a second sheave where the ends of the belts are fastened, as illustrated in FIG. 1.

Figure 2:
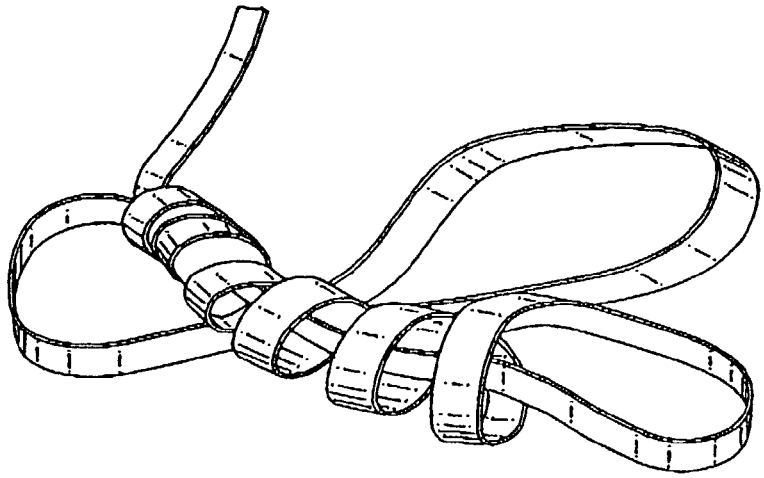
FIG. 2 Prior Art
FIG. 2 is an illustrative view of the entanglement of the coated steel belts resulting from use of the prior art method of installing coated steel belts as tension members in elevator systems.

However, when conventional methods were employed to install the new coated steel belts 10, the belts 10 became entangled as illustrated in FIG. 2 (Prior Art).

Figure 3:
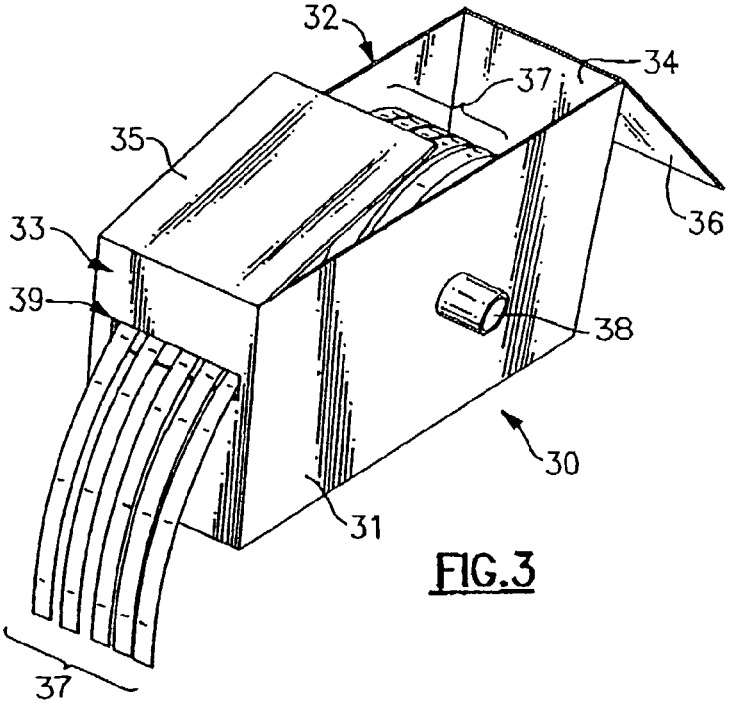
FIG. 3 is a perspective view of the dispenser in its dispensing mode after the ends of the steel belts have been pulled through the dispensing hole.

As seen in FIG. 3, the box-like container 30 includes a substantially rectangular bottom panel (not shown). Foldably connected to opposite sides of the bottom panel are a generally rectangular first side panel 31 and a generally rectangular second side panel 32. Foldably connected to opposite sides of the first side panel 31 are a generally rectangular front panel 33 and a generally rectangular back panel 34. Foldably connected to the top edge of the front panel 33 is a generally rectangular top panel 35 having the same width as the bottom panel, but half the length and foldably attached to the top edge of the opposing back panel 34 is a generally rectangular top panel 36 having the same width as the bottom panel, but half the width so that when both top panels 35 and 36 are folded inward towards the bottom panel, they meet at the center to close the open portion of the storage and dispensing device 30.

The desired number of coated steel belts 37, intended for installation, are individually rolled from end to end in such a manner that each individual roll has a free unencumbered center capable of allowing a hollow core 38 to pass therethrough. A plurality of the steel belt rolls 35 are retained vertically and side-by-side in a one-piece box-like container 30. FIG. 3 depicts an embodiment in which five individual coated steel belt rolls 37 have been positioned in the dispenser for simultaneous installation. The rolls are arranged so that the centers are in alignment so as to allow a hollow core or axel 38 to pass through the center of each coated steel belt roll to rotatably support each roll and prevent the steel belt from coming in contact with the bottom panel of the dispenser 30.

A circular, parallel perforation (not shown) is located in the first side panel 31. A second perforation (not shown) is located in the opposing side panel 32 that is parallel to the perforation in the first side panel 31. The perforations are positioned so as to be in alignment with the centers (not shown) of the coated steel belt rolls 37. Prior to use, the installer punches out the aforementioned perforations and discards the circular punched-out portions. Each side wall 31 and 32, now has a circular opening to allow a core or axle 38 to pass through. The core should not pass completely through the first hole, but a portion of the core should be rotatably supported by the first side panel. The hollow core is subsequently passed through the center of each steel belt roll and out the newly created hole of the opposing side wall 32. The length of the hollow core 38 should be longer than the width of the dispenser 30 so that both ends of the core 38 extend beyond the side walls 31 and 32 of the dispenser 30. The core or axle 38, having been slidably mounted through the pair of opposing holes in the sidewalls 31 and 32 is rotatably supported or cradled by the side walls 31 and 32 allowing for rotational motion during the unrolling and dispensing of the coated steel belts.

The core 38 may lift the coated steel belts vertically upward so that the weight of the roll rests on the core 38. When a tension force is applied to the free end of the belt rolls, the rolls rotate about the core 38. This motion dispenses the belts from the rolls. The core 38 holds the rolls in place while raising the rolls off the bottom of the dispenser 30 so as to prevent chaffing of the belts during dispensing.

An elongated, generally rectangular perforation 39 is incorporated into the front end panel 33. During use, the perforation 39 is removed forming a horizontal slit. The steel belt rolls 35 are positioned in the dispenser 30 so that the free end of each steel belt roll is situated so that it can be easily retrieved by the technician and pulled through the dispensing slot 39. Ideally, each steel belt roll is positioned in the dispenser 30 so that when the steel belt is pulled by the technician, a portion of the steel belt unravels from the roll and extends outward through the dispensing slit 39.

Figure 4:
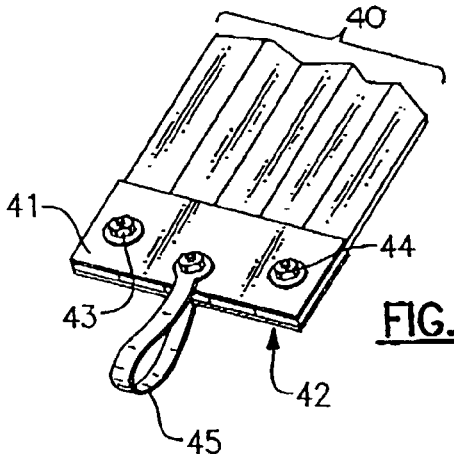
FIG. 4 is a perspective view of the clamp used to retain a plurality of the belts in locking contact in anticipation of installation in an elevator system.

Referring to FIG. 4, equal lengths of several coated steel belts 40 are pulled through the dispensing slot 39 of FIG. 3 by the installer. The ends of the belts are aligned and secured between two steel plates 41 and 42. These plates also may be composed of any rigid material such as plastic or fiberglass, for example. The plates 41 and 42 are held tightly together by at least one bolt 43, preferably two 43 and 44 as illustrated. As the bolts 43 and 44 are tightened, the plates apply a compression force on the ends coated steel belts retained between the plates 41 and 42, which secures the belts between the plates and prevents movement of the ends. It is important that the bolts 43 and 44 not be driven into the steel belts or that the coated steel belts be damaged during the clamping process.

Once clamped, a pulling means 45 is affixed to at least one of the plates 41 and 42. A pull tab 45, may be bolted to the plates 41 and 42 after the coated steel belts 40 have been secured. Again, caution needs to be exercised by the technician to prevent damage to the belts. In another embodiment, the pulling means 45 may be affixed to one of the plates prior to the clamping process. The pulling means 45 is not limited to a tab or its equivalent. For example, holes, either pre-formed or forged during installation, can be drilled in one or both plates to allow a hook or its equivalent to engage the plate-belt combination and pull it during the installation process. Ideally the holes are formed in that portion of the plate that extends beyond the end of the belts to prevent damage to the belts 40.

Figure 5:
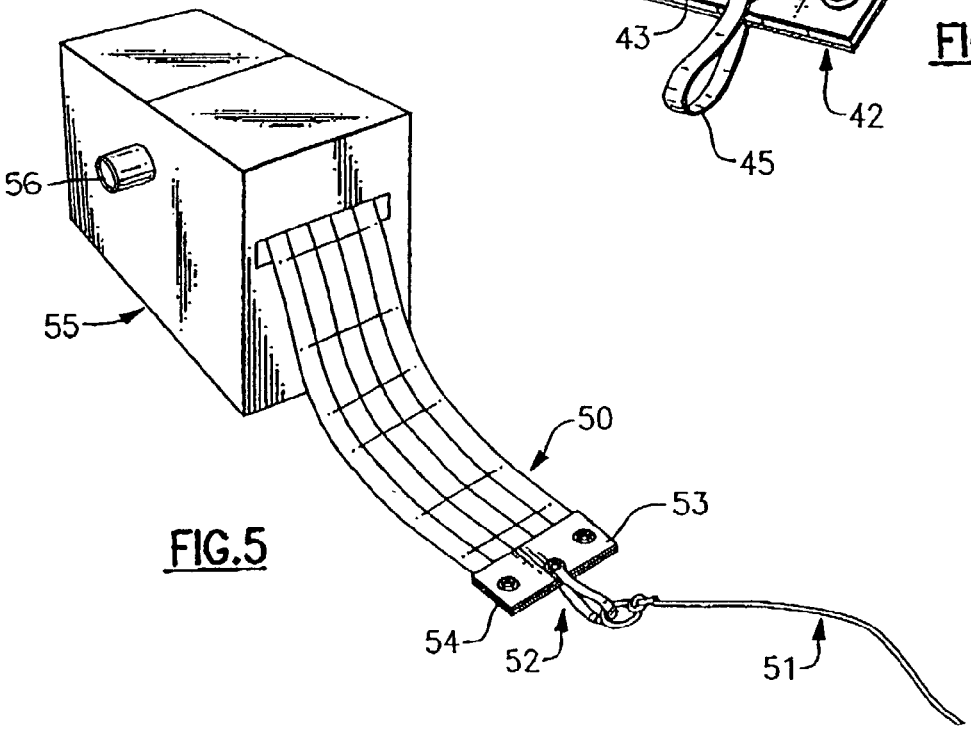
FIG. 5 is a perspective view of the dispensing device after a portion of each of the steel belts contained therein has been pulled through the dispensing hole and the individual steel belts have been secured together by the clamp and the clamp has been attached to a guide member.

Referring to FIG. 5, once assembled, a guide 51 is attached to a pulling means 52 of the clamped plates 53 and 54. The installer uses the guide 51 to feed the clamped belts 50 about the elevator system during installation. As a tension force is applied to the guide 51, the rolls of coated steel belts contained in the dispenser 55 rotate about the core 56, dispensing a controlled amount of each belt as described and illustrated in FIG. 3.

Figure 6:
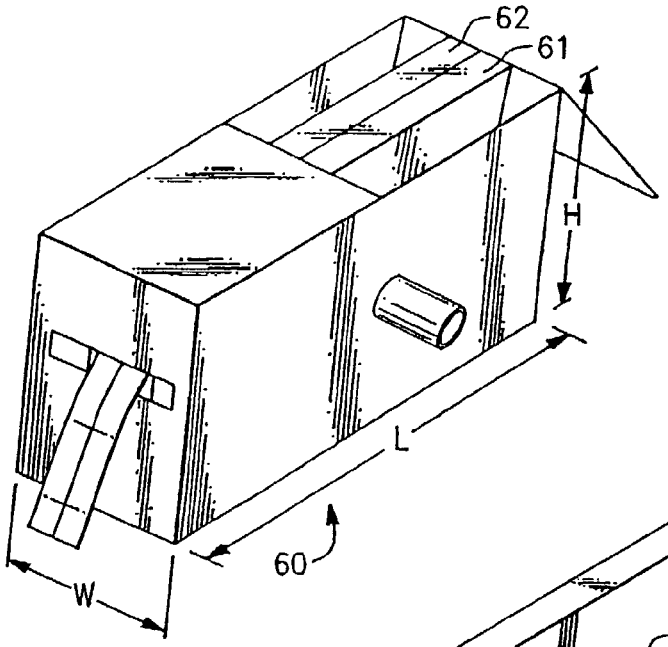
FIG. 6 is a perspective view of one embodiment of the present invention in which each roll of coated steel belt is stored in a separate individual retaining box, a plurality of individual boxes are then placed in the dispensing box in anticipation of use.
Figure 7:
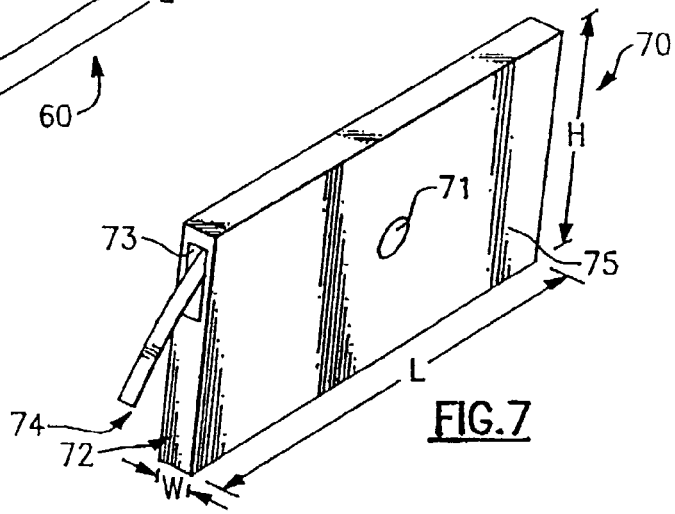
FIG. 7 is a perspective view of an individual retaining box containing a coated steel belt that can be slid into a dispenser as illustrated in FIG. 6.

Referring to FIG. 6, to facilitate the installation process, individual rolls of coated steel belts may be pre-packaged in individual containers 61 and 62. These individual containers 61 and 62 are constructed in a manner similar to that used in constructing the dispenser 60. Referring to FIGS. 6 & 7, each individual container 70 depicted in FIG. 6, has the approximate length and height as that of the dispenser container 60. However, the width of the individual containers 61 and 62 are only slightly greater than the widths of the coated steel belt and substantially less than the width of the container 60 as shown in FIG. 7. Each individual container 61 and 62 has circular, parallel perforations 71 (the perforation in the opposing side panel is not shown) in each side panel that can be removed by the installer to allow the center core to pass completely there through. The front panel 72 of each individual container 70 also contains an elliptical perforation slot 73 that can be removed to create a slot allowing access to the free end 74 on the periphery of the steel belt roll contained therein so that the technician may apply a tension force to said free end 74 to cause the controlled dispensing of the steel belt 74.

Figure 8:
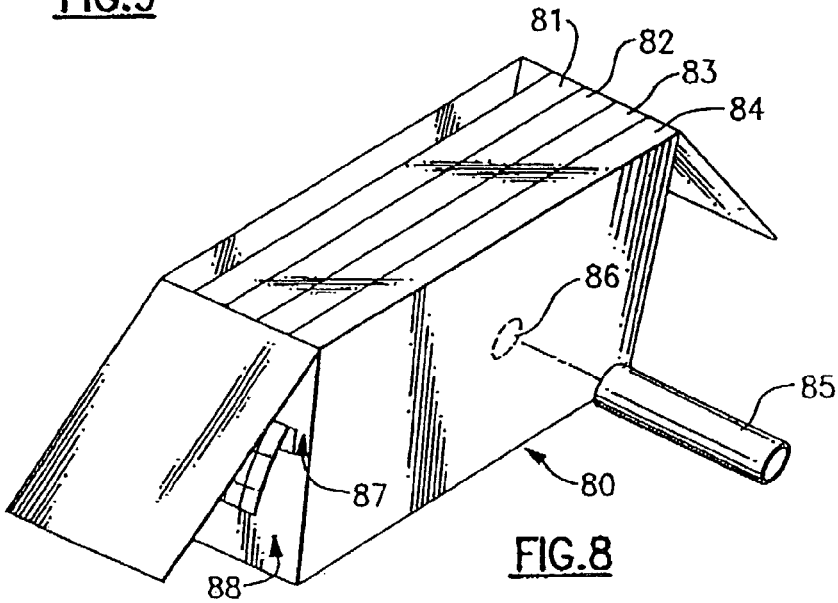
FIG. 8 is another perspective of the embodiment illustrated in FIG. 6 showing the placing of individual boxes containing coated steel belts after being positioned in the dispenser and removing the side wall perforations to allow the hollow cylindrical axel/core to pass therethrough.

Referring to FIG. 8, the individual containers 81, 82, 83 and 84 house equal length rolls of coated steel belts. Each roll has a center to allow an axle core 85 to pass through the side walls of each individual container and through the belt roll 85 contained within each individual container 81, 82, 83, and 84.

Before installation, the desired number of individual containers 81, 82, 83 and 84 containing a single belt roll are slid vertically into the dispenser 80 so that the perforated holes (not shown) contained in the side panels of the individual containers 81, 82, 83 and 84 align with the perforated holes 86 contained in the side panels of the dispenser 80. The dispenser slot (not shown) of each front panel of each individual container 81, 82, 83 and 84 should align with the dispensing slot 87 contained in the front panel 88 of the dispenser 80. If inserted correctly, the core 85 should pass through the holes contained in the side panels of the dispenser 80 once the perforations are removed, through the holes contained in the side panels (not shown) of each individual container 81, 82, 83 and 84, through the centers (not shown) of each steel belt roll contained therein and through the hole (not shown) contained in the opposite side panel (not shown) of the dispenser 80. As stated previously, the side walls of the dispenser 80 rotatably cradle the core 85 after it is properly positioned. Also, if the individual containers 81, 82, 83 and 84 are positioned correctly in the main dispenser 80, the ends at the periphery of the steel belt rolls (not shown) contained in each individual container 81, 82, 83 and 84 should be accessible and easily pulled through both the dispensing slot of each respective individual container 81, 82, 83, 84 and the main dispenser 80.

Figure 9:
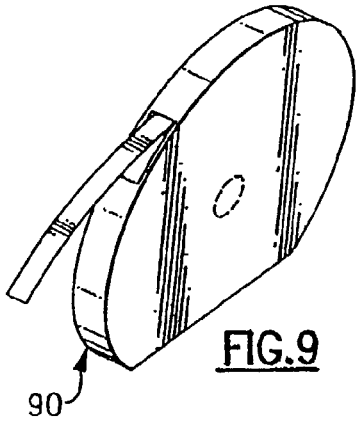
FIG. 9 is a perspective of another embodiment of the invention in which the individual containers housing the individual roll of a coated steel belt has a circular shape.

Referring to FIG. 9, the shape of the individual containers 90 need not be rectangular. The shape of the individual containers may be circular to cut down on the amount of material used in the manufacture of these containers. Although depicted as having a flat bottom so that it can rest on the bottom panel of the main dispenser, a full canister-like individual container may be employed.

Figure 10:
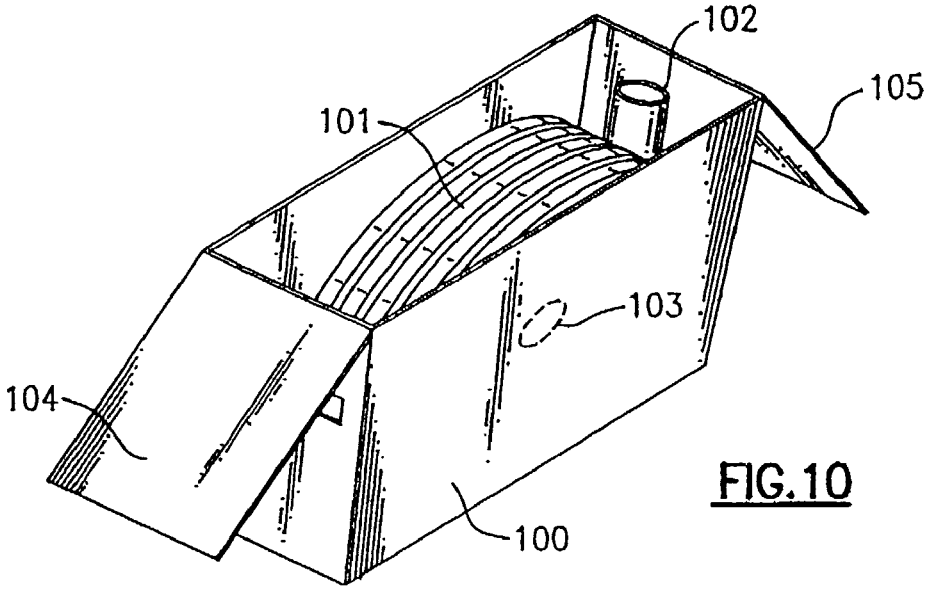
FIG. 10 is a perspective view of the dispenser in its storage and transportation mode.

Referring to FIG. 10, the portability and storage capabilities of the dispenser are illustrated. A number of rolls of coated steel belts can be pre-installed in the dispenser prior to use. Sufficient room exists in the interior of the dispenser 100 to allow for storage of the cylindrical core 102. The side circular, parallel perforations 103 (opposing perforation not shown) have not yet been removed to seal the interior of the dispenser from dust or other contaminants which could effect the steel belts. The top panels 104, 105 have been folded outward to expose the interior of the dispenser. A handle means could be incorporated into one top panel to assist in the transportation of the dispenser and coated steel belt rolls.

Figure 11:
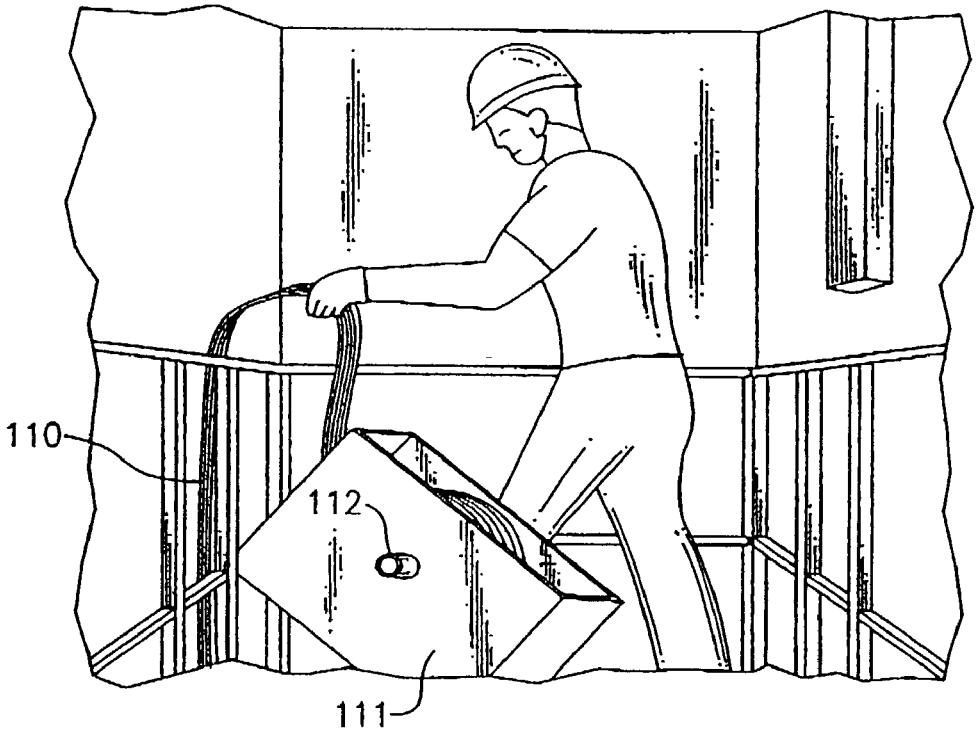
FIG. 11 is a perspective view of the method of this invention to install a plurality of coated steel belts as tension members for an elevator system.

Referring to FIG. 11, the method described in the patent is illustrated. The technician pulls a portion of each steel belt contained in the dispenser, clamps them together and feeds the clamped steel belts 110 down the elevator shaft. It is desirable to tilt the dispenser at an angle to ease the feeding processes. As equal lengths of the cables are pulled from the individual belt steel rolls, the rolls rotate, about the inner core 112 which prevents the rolls from coming in contact with the bottom panel of the dispenser 11. As illustrated, the present invention allows for the controlled dispensing of a plurality of steel belt cables.

Figure 12:
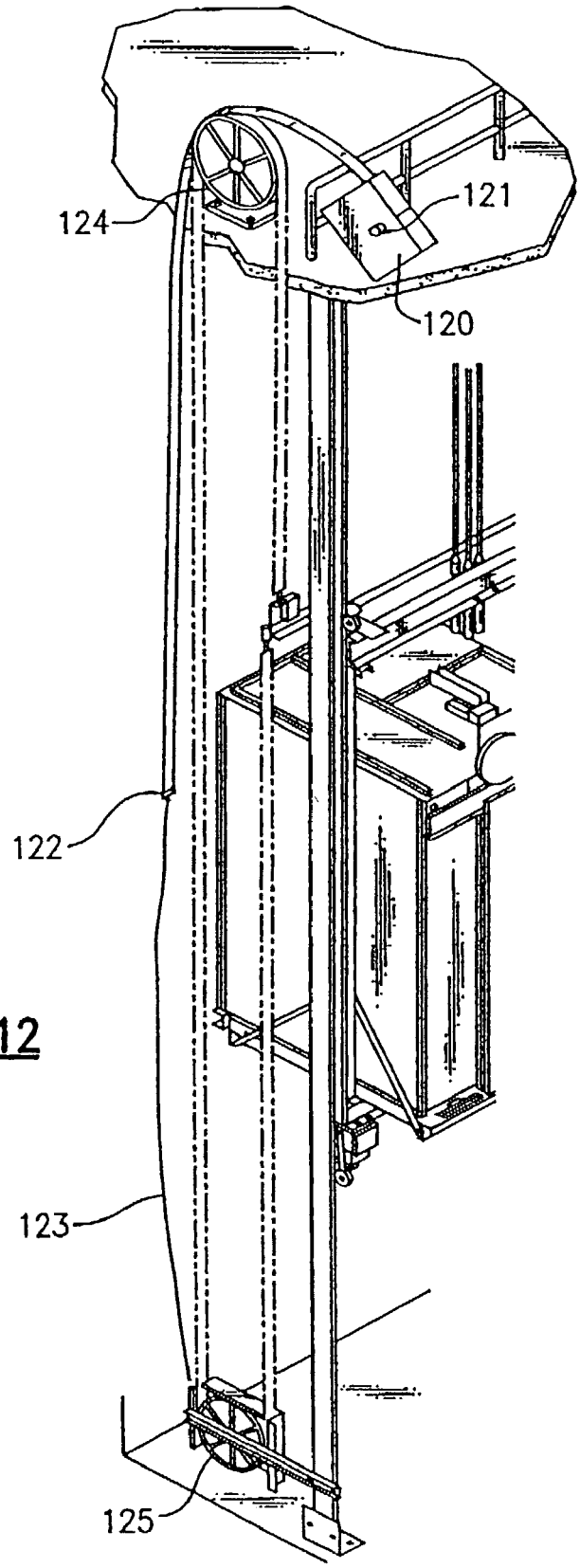
FIG. 12 is a perspective view of the method of the present invention in which the retaining member dispenses even lengths of a plurality of coated steel belts which in turn are secured together by a clamp which is connected to a guide and fed down the shaft of an elevator so that the steel belts are aligned with the system and are easily installed as tension members for the elevator system.

Referring to FIG. 12, an example installation process is illustrated. The dispenser box 120 containing the individual containers which in turn contain equal lengths of rolled coated steel belts is positioned at the top of the elevator system. The perforated punch-outs have been removed and the cylindrical core 121 has been passed through the side wall holes in the dispenser box 120, through each side wall hole of the individual containers (not shown) and through the centers of each steel belt roll (not shown). The cylindrical core 121 is rotatably cradled by the side walls of the dispenser 120 and in turn, suspends the belt rolls contained therein to ease the installation process. The perforated dispensing slots of each individual container (not shown) as well as the perforated punch-out contained in the front wall of the dispenser to create the dispensing slot (not shown), are removed and the free ends of each steel belt contained in the dispenser 120 are pulled out of the dispenser 120 by the technician. The free ends of the belts are aligned and are positioned between two plates 122 which are bolted together so as to hold the free ends of the belts in locking contact. The pulling means (not shown) of the two plates is attached to a guide 123, which is fed around a top sheave 124 down the elevator shaft around a lower sheave 125 and up the shaft. As tension is applied to the guide 123, it in turn pulls on the secured belts. The affixed belt rolls rotate about the center core 121 of the dispenser 120 causing controlled lengths of the steel belts to be evenly pulled from the rolls.

As demonstrated, the described method for installing coated steel belts as elevator tension means is preferable over conventional techniques. In the time it took to install one belt using traditional methods, a technician can install 3, 5 or more belts. Entanglement is minimized due to the controlled feeding of the belts through the elevator system. Because the belts are secured to the plates prior to installation, proper orientation of the belts relative to the sheave is achieved. The described method also provides a safe means of storing and transporting coated steel belts. A number of belts can be installed at the same time, thus decreasing the time required to install the belts resulting in decreased installation costs.

In yet another embodiment, an integral handle structure may be incorporated into the design of the dispenser so as to ease transportation of the dispenser. A panel may contain parallel slits capable of retaining the flared ends of a handle-like structure into locking contact with the dispenser and individual roll containers. The dispenser may be constructed from corrugated cardboard, plastic or any like material. The dispenser is designed to be mass produced and can be discarded or reused. The dimensions of the dispenser and the individual containers can vary depending on need. Although rectangular, the dispenser may have other geometric shapes.

Although the invention has been shown and described with respect to exemplary embodiments thereof, it should be understood by those skilled in the art that various changes, omissions and additions may be made thereto, without departing from the spirit and scope of the invention.

What is claimed is:

1. A container and elevator belt assembly, comprising:

a container structure having at least a base and a plurality of sidewalls extending from the base;

a plurality of elevator load bearing members received between the sidewalls, within the container structure and individually rolled into a plurality of rolls such that a first end is near a center of each roll between the sidewalls, within the container structure and a second end is near an outer periphery of each roll; and a shaft having first and second portions directly contacting corresponding ones of the sidewalls such that the shaft is supported by the sidewalls and a central portion between the first and second portions that directly contacts the first ends of the load bearing members.

2. The assembly of claim 1, wherein the side panels include openings through which the first and second portions of the shaft are received, respectively.

3. The assembly of claim 1, wherein the shaft is cylindrical.

4. The assembly of claim 1, wherein the container structure side panels are connected to the base and the container structure includes a front panel connected to at least one of the side panels, a back panel connected to at least one of the side panels and at least one top panel foldably connected to one of the front, back or side panels such that when the top panel is folded, the container structure has a closed inner recess that receives the load bearing members.

5. The assembly of claim 4, wherein the front panel includes an opening that is large enough to allow all of the second ends to pass through the opening for selective dispensing of the belts from the container structure.

6. The assembly of claim 1, wherein the container structure comprises corrugated cardboard.

7. The assembly of claim 1, wherein the container structure comprises plastic.

8. The assembly of claim 1, including a handle associated with the container.

9. The assembly of claim 1, wherein the shaft is rotatable relative to the sidewalls.

* * * * *